US005383661A

United States Patent [19]

Beck

[11] Patent Number: 5,383,661

[45] Date of Patent: Jan. 24, 1995

[54] APPARATUS TO RETRIEVE TENNIS BALLS

[75] Inventor: Andrew L. Beck, Winston-Salem, N.C.

[73] Assignee: Andiff Corporation, Winston-Salem, N.C.

[21] Appl. No.: 97,470

[22] Filed: Jul. 26, 1993

[51] Int. Cl.[6] ..... A63B 49/00

[52] U.S. Cl. ..... 273/73 R

[58] Field of Search ..... 273/73 R, 162 R, 162 E, 273/81 R

[56] References Cited

U.S. PATENT DOCUMENTS

| | | | |
|---|---|---|---|
| 2,801,875 | 8/1957 | McEvoy | 273/73 R |
| 3,462,184 | 8/1969 | Russell | 273/73 R |
| 3,922,027 | 11/1975 | Nesselt | 273/162 E X |
| 3,989,247 | 11/1976 | Zimmerman | 273/73 R |
| 4,183,526 | 1/1980 | Brown | 273/73 R X |
| 4,210,327 | 7/1980 | Schubert | 273/73 R |
| 4,216,831 | 8/1980 | Ritchie | 273/162 E X |
| 4,979,742 | 12/1990 | DeFranco | 273/73 R X |
| 5,092,593 | 3/1992 | Williams et al. | 273/73 R |

FOREIGN PATENT DOCUMENTS

| | | | |
|---|---|---|---|
| 2539633 | 7/1984 | France | 273/73 R |
| 2591497 | 6/1987 | France | 273/73 R |
| 4017483 | 12/1991 | Germany | 273/73 X |
| 480051 | 4/1953 | Italy | 273/73 R |
| 799947 | 8/1958 | United Kingdom | 273/73 R |
| 1108829 | 4/1968 | United Kingdom | 273/162 E |

*Primary Examiner*—William E. Stoll

[57] ABSTRACT

Apparatus is provided to retrieve tennis balls by attachment to a tennis racket. The apparatus consists of a bracket having a pair of arms positioned between side walls which are affixed to an arcuate base. The arms are pivotable and can be opened to extend upwardly, from the base where they form an opening slightly smaller than the diameter of a tennis ball. The bracket is attached to the top of the tennis racket and will receive tennis balls that are on the ground without the user having to stoop or bend in order to pick the balls up. Once the desired balls have been gathered the arms can be folded back into the bracket where they remain out of the way during play.

12 Claims, 2 Drawing Sheets

APPARATUS TO RETRIEVE TENNIS BALLS

BACKGROUND OF THE INVENTION

1. Field Of The Invention

The invention herein pertains to an apparatus for attachment to a tennis racket, and particularly to an apparatus for attachment to the head of a tennis racket to retrieve tennis balls between games.

2. Description Of The Prior Art And Objectives Of The Invention

Various devices for attachment to tennis rackets have been conceived in the past to pick up and retrieve tennis balls. Usually these devices consist of hook and loop fastening material attached either at the bottom of the handle or at the top of the head of a racket and generally include hook material which will engage the nap of new tennis balls. Such device can be found in Feldi U.S. Pat. No. 4,834,393. Other devices may consist of brackets having rigid arms which extend outwardly as shown in U.S. Pat. No. 4,993,712. While hook and loop fasteners are usable with high nap new balls, the nap quickly and easily becomes worn when playing on polymer or concrete surfaces, rendering such retrievers virtually useless. Also, prior art devices which are easily removable can become misplaced or lost and are rarely available when needed.

Thus, with the problems and disadvantages of prior art ball retrieval devices, the present invention was conceived and one of its objectives is to provide an easily operable, durable tennis ball retrieval device.

It is still another objective of the present invention to provide an apparatus for retrieving tennis balls which can be readily manually opened for use and which can be quickly closed and out of the way during playing.

It is yet another objective of the present invention to provide an apparatus consisting of a bracket having pivotable arms formed from a durable, rigid plastic.

It is yet another objective of the present invention to provide an apparatus for retrieving tennis balls which is relatively simple to manufacture and which can be inexpensively purchased by a tennis player.

Various other objectives and advantages of the present invention will become apparent to those skilled in the art as a more detailed description is set forth below.

SUMMARY OF THE INVENTION

Apparatus for retrieving tennis balls as hereinbefore mentioned consists of a bracket having pivotable arms which are manually openable when needed. The apparatus can be mounted at the top of the tennis racket head by conventional draw straps which surround the frame to secure the bracket thereon. The pivotable arms are affixed to rotatable pins which pass through the side walls of the bracket, the side walls defining apertures through which the draw straps pass. Once mounted on the tennis racket head, the arms can be closed and the tennis racket used for playing without consideration to the retrieval apparatus. After a game is finished, the player can manually open the arms and by holding the tennis racket by the handle with the head down, press the opened arms over a tennis ball which is for example, on the ground. This will slightly compress the ball and hold it between the arms until removed. After such use the arms are again folded into their closed position and the racket can then be used again for playing.

DESCRIPTION OF THE PREFERRED EMBODIMENT

The preferred form of the invention is shown in FIGS. 1–6 whereby apparatus for retrieving tennis balls includes a bracket having an arcuate base with side walls positioned thereon. Pivotably attached to the side walls are a pair of opposing arms which can be manually lifted substantially perpendicular to the base. Once so opened, the arms can then frictionally engage and hold a tennis ball. The device is positioned preferrably at the top of a tennis racket head and is held in place by conventional plastic draw straps which pass through openings in the side walls and encircle the racket frame along the top. The device has a length of approximately three inches and a height of approximately three-eighths inch when the arms are closed and the arms open approximately to a height of one and one-half inches measured from the top of the racket head. Notches are available at the center of the side walls which allow easy finger access to the T-shaped arms for gripping during opening. The notches also provide an arcuate bottom rest for the ball when it is held and positioned between the arms. The device is preferrably molded from a durable, rigid plastic material.

DETAILED DESCRIPTION OF THE DRAWINGS AND OPERATION OF THE INVENTION

Figure 3:
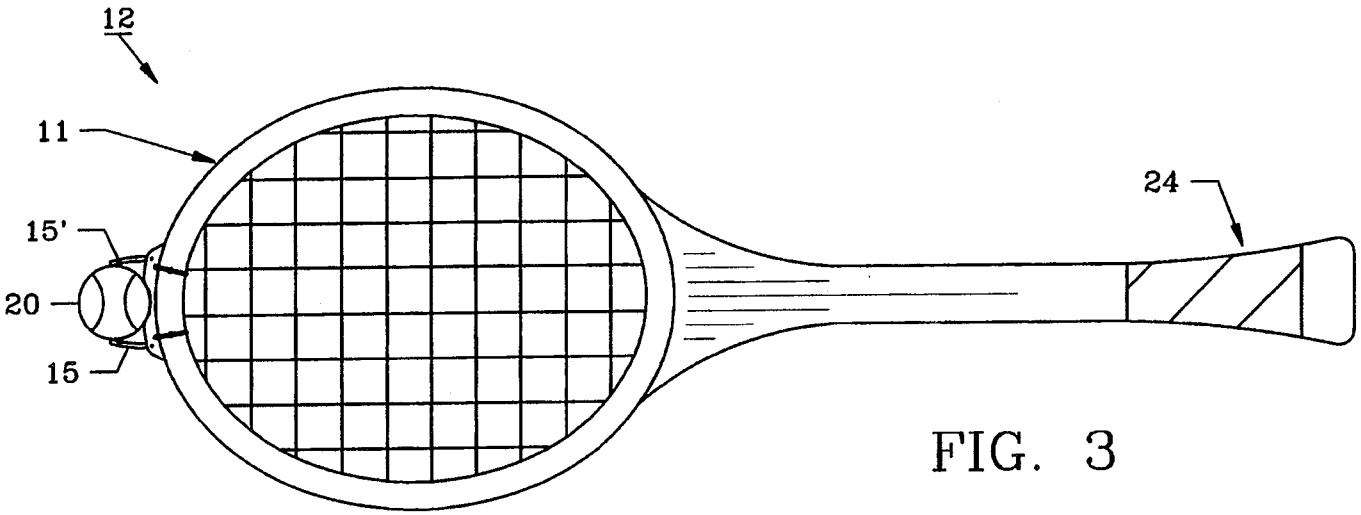
FIG. 3 shows the tennis racket of FIG. 1 with the pivotable arms open, engaging a tennis ball.
Figure 1:
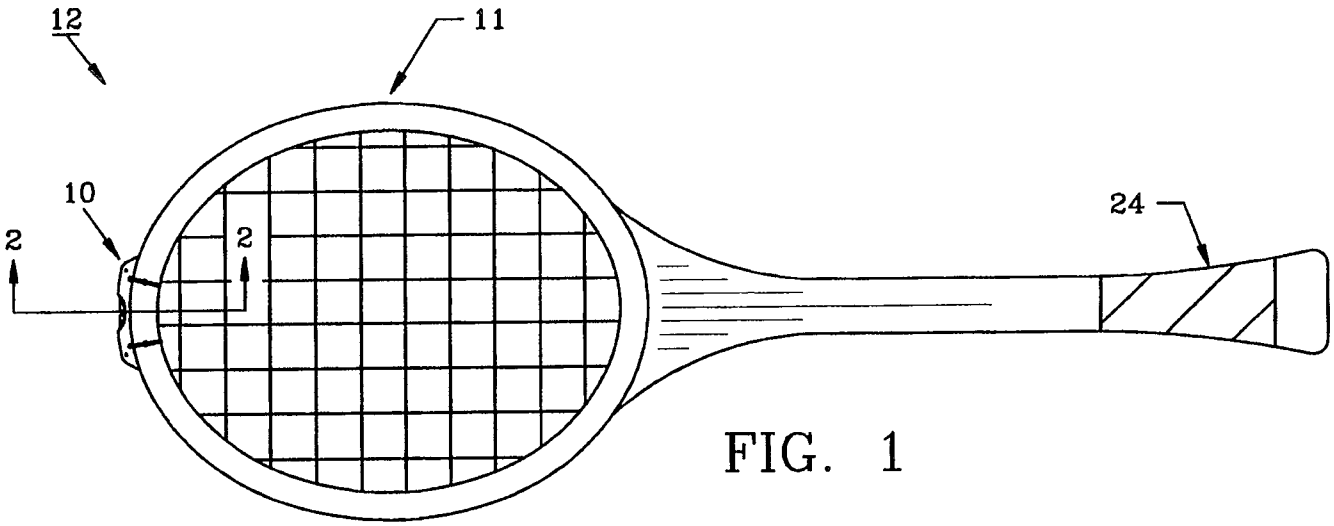
FIG. 1 illustrates a conventional tennis racket with the apparatus of the invention closed and affixed thereto.
Figure 4:
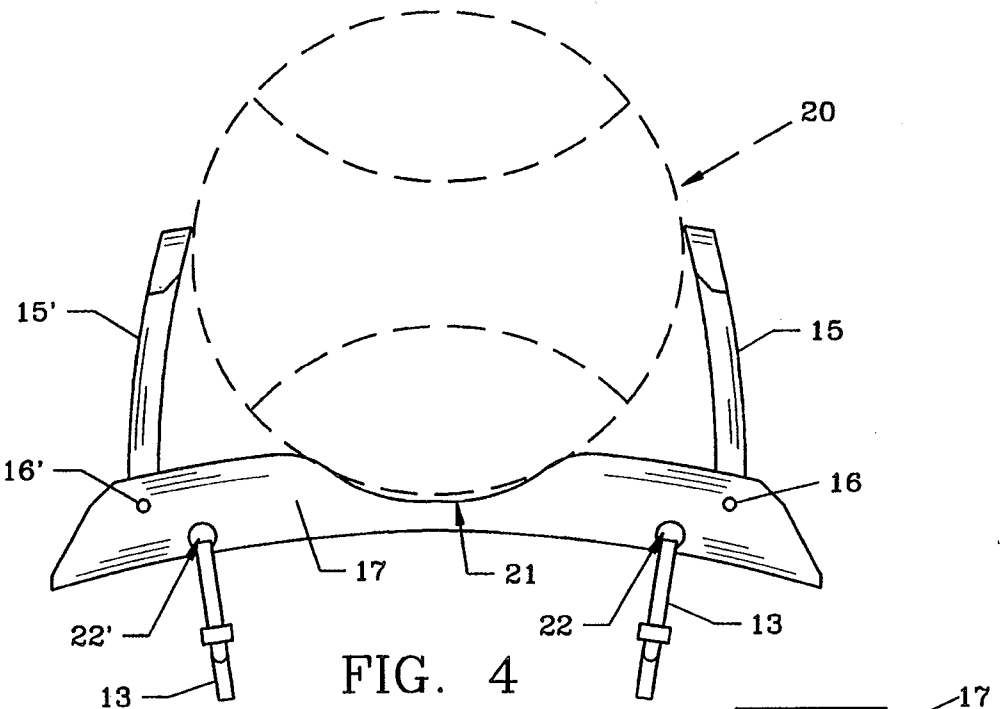
FIG. 4 pictures an enlarged right side view of the device as featured in FIG. 3 removed from the tennis racket and holding a tennis ball illustrated in ghost form.
Figure 6:
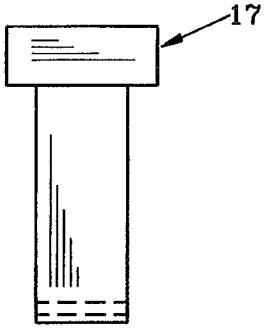
FIG. 6 shows an enlarged front elevational view of one of the arms as removed from the bracket.
Figure 2:
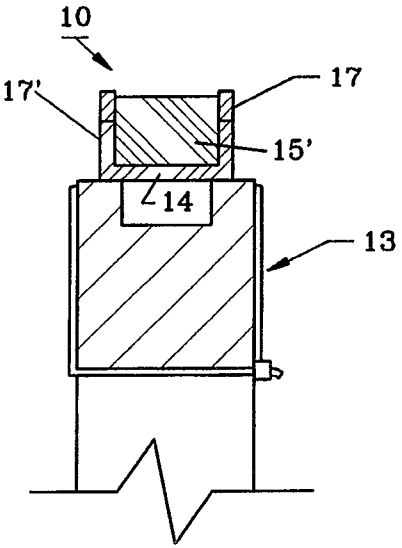
FIG. 2 demonstrates an enlarged cross-sectional view of the device as seen in FIG. 1 along lines 2—2.
Figure 5:
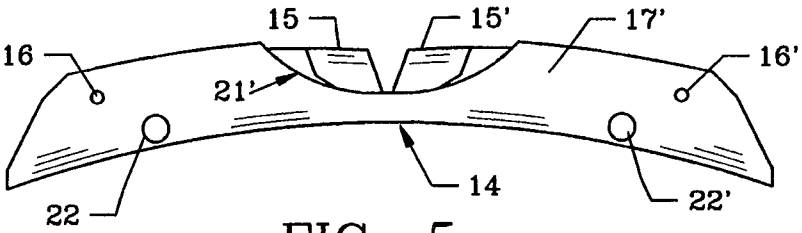
FIG. 5 illustrates an enlarged left side view of the device as shown in FIG. 4 but with the arms in a closed position.

Turning now to the drawings, FIG. 1 demonstrates bracket 10 positioned atop head 11 of tennis racket 12. As seen in FIG. 2, bracket 10 is attached to the top of head 11 by conventional draw straps 13. While in play, arms 15, 15' which are pivotably attached to side walls 17, 17' as axle pins 16, 16' pass through walls 17, 17' and through arms 15, 15' forming an axis of rotation. Side walls 17, 17' make slight frictional contact with arms 15, 15' and prevent arms 15, 15' from inadvertently opening during play. Arms 15, 15' are somewhat T-shaped as shown in FIG. 6. Arm 15 may be for example, one and one-quarter inches in length and may have a width of approximately five-eighths of an inch at the top of the "T" to provide an adequate grip on conventional tennis balls 20 as shown in FIGS. 3 and 4. Base 14 is arcuately shaped along its bottom as shown in FIG. 5 to fit the outer periphery or contour of racket head 11. As would be understood, the exact diameter of base 14 can be varied, to accommodate other larger or smaller rackets.

As further seen in FIG. 5, wall 17' like wall 17 (not shown in FIG. 5) defines an arm access notch 21' which allows the user to easily grasp arms 15, 15' with the fingers and position them approximately vertical to base 14 as seen in FIG. 4 for receiving a tennis ball therebetween. Additionally, notch 21 has a diameter slightly larger than the diameter of tennis ball 20 so ball 20 can rest thereagainst when frictionally held between arms 15, 15'. Side walls 17, 17' also define apertures 22, 22' as seen in FIGS. 4 and 5 for receiving draw strap 13 therethrough.

In use, racket 12 is held by handle 24 with head 11 pointed downwardly towards the ground. Arms 15, 15' are opened manually as shown in FIGS. 3 and 4 and are placed over the top of a tennis ball which may be lying somewhere on or nearby the tennis court. By pressing slightly downward against ball 20 it will slightly compress and be urged upwardly between arms 15, 15' and against notches 21, 21'. Racket 12 can then be lifted to an upright position and tennis ball 20 manually removed therefrom. This can be repeated as often as necessary for ball collection. Arms 15, 15' are then manually folded downwardly into a closed position as shown in FIG. 5 where they remain out of the way during playing.

The illustrations and examples provided herein are for explanatory purposes and are not intended to limit the scope of the appended claims.

I claim:

1. An apparatus for placement on a game racket to retrieve balls used therewith comprising: a base, means to attach said base to the top of a game racket, said attaching means joined to said base, a pair of foldable arms, said arms pivotally joined to said base to fold substantially parallel thereto, said arms for receiving a ball therebetween when unfolded substantially perpendicular from said folded position.

2. The apparatus of claim 1 wherein said bracket comprises a base, a pair of side walls, and said side walls attached to said base.

3. The apparatus of claim 2 wherein said arms are pivotally attached to said side walls.

4. The apparatus of claim 2 wherein said base is arcuately shaped.

5. The apparatus of claim 2 wherein each of said side walls define an aperture, said aperture for receiving a draw strap.

6. The apparatus of claim 1 wherein said attaching means comprises a draw strap.

7. The apparatus of claim 1 wherein said arms have a T-shaped configuration.

8. The apparatus of claim 1 wherein said base is molded from rigid plastic.

9. An apparatus for attachment to a game racket to retrieve game balls comprising: a base, a means to attach said base to the game racket, said attaching means joined to said base, a pair of side walls, said side walls attached to said base, a pair of arms, said arms pivotally attached to opposite ends of said side walls, said arms pivotable from a closed position against said base to an open position approximately perpendicular to said base for receiving a ball therebetween.

10. The apparatus of claim 9 wherein said arms are T-shaped.

11. The apparatus of claim 9 wherein said attaching means comprises a draw strap.

12. The apparatus of claim 9 wherein said base is arcuately shaped.

* * * * *